US011371539B2

(12) United States Patent
Zwerenz et al.

(10) Patent No.: US 11,371,539 B2
(45) Date of Patent: Jun. 28, 2022

(54) HYDRAULIC ARRANGEMENT HAVING LINKED HYDRAULIC UNITS, CLIMBING FORMWORK, AND METHOD FOR MOVING THE CLIMBING FORMWORK USING SUCH A HYDRAULIC ARRANGEMENT

(71) Applicant: Peri AG, Weissenhorn (DE)

(72) Inventors: Andre Zwerenz, Oy-Mittelberg (DE); Dieter Deifel, Blaustein (DE); Bogdan Parnica, Senden (DE)

(73) Assignee: Peri AG, Weissenhorn (DE)

( * ) Notice: Subject to any disclaimer, the term of this patent is extended or adjusted under 35 U.S.C. 154(b) by 0 days.

(21) Appl. No.: 16/754,099

(22) PCT Filed: Oct. 5, 2018

(86) PCT No.: PCT/EP2018/077160

§ 371 (c)(1),
(2) Date: Apr. 6, 2020

(87) PCT Pub. No.: WO2019/068879

PCT Pub. Date: Apr. 11, 2019

(65) Prior Publication Data

US 2020/0332812 A1 Oct. 22, 2020

(30) Foreign Application Priority Data

Oct. 5, 2017 (DE) ..... 10 2017 217 715.2

(51) Int. Cl.
*F15B 21/08* (2006.01)
*F15B 21/02* (2006.01)
(Continued)

(52) U.S. Cl.
CPC ..... *F15B 21/02* (2013.01); *E04G 11/28* (2013.01); *F15B 15/20* (2013.01); *F15B 21/08* (2013.01); *F15B 2211/40* (2013.01)

(58) Field of Classification Search
CPC ..... F15B 11/22; F15B 21/085
(Continued)

(56) References Cited

U.S. PATENT DOCUMENTS 3,241,458 A * 3/1966 Goldie ..... C21D 1/673 91/171
4,702,148 A * 10/1987 Kussel ..... F15B 11/22 91/527
4,777,798 A * 10/1988 Jacobson ..... F15B 11/22 60/327
(Continued)

FOREIGN PATENT DOCUMENTS

CN 1544783 11/2004
CN 101685304 3/2010
(Continued)

OTHER PUBLICATIONS

"Doka automatic climbing formwork SKE 50 and SKE 100," published Jul. 2006.

*Primary Examiner* — Michael Leslie
(74) *Attorney, Agent, or Firm* — Loginov & Associates, PLLC; William A. Loginov

(57) ABSTRACT

A hydraulic arrangement. The hydraulic arrangement has multiple hydraulic units, the control units of which are connected, in particular in series, via a data connection. The control units are preferably designed to control selectively only hydraulic cylinders directly associated with said units, or also indirectly control, via the data connection and the control unit of an additional hydraulic unit, the hydraulic cylinders associated with said additional hydraulic unit. A climbing formwork having at least one climbing unit, in particular multiple climbing units. The hydraulic units can be linked via the data connection such that synchronous lifting and/or lowering of all climbing units can be or is achieved. The hydraulic units are preferably connected in a master-slave arrangement or are preferably controlled in a master-slave mode. Also preferably, the hydraulic units are designed to switch from the master-slave mode to the stand-alone mode.

17 Claims, 8 Drawing Sheets

(51) Int. Cl.
*E04G 11/28* (2006.01)
*F15B 15/20* (2006.01)

(58) Field of Classification Search
USPC ..... 91/171, 508, 515
See application file for complete search history.

(56) References Cited

U.S. PATENT DOCUMENTS

| | | | | |
|---|---|---|---|---|
| 5,000,287 | A * | 3/1991 | Schworer | E04G 11/28 182/136 |
| 5,065,844 | A * | 11/1991 | Hon | B66B 9/04 187/275 |
| 6,189,432 | B1 * | 2/2001 | Colarelli | B66F 7/20 91/171 |
| 6,817,449 | B2 * | 11/2004 | Berends | B66F 7/20 187/213 |
| 8,020,271 | B2 * | 9/2011 | Baum | E04G 11/22 29/407.05 |
| 9,468,961 | B2 * | 10/2016 | Davi | F15B 11/16 |
| 10,465,398 | B2 * | 11/2019 | Herzog | E04G 11/24 |
| 2020/0332539 | A1 * | 10/2020 | Deifel | E04G 11/28 |

FOREIGN PATENT DOCUMENTS

| | | |
|---|---|---|
| EP | 3339535 | 6/2018 |
| RU | 2369705 C1 | 10/2009 |
| RU | 2370606 C1 | 10/2009 |
| SU | 1756488 A1 | 8/1992 |
| WO | 2013120419 | 8/2013 |
| WO | 2017072654 | 5/2017 |

* cited by examiner

HYDRAULIC ARRANGEMENT HAVING LINKED HYDRAULIC UNITS, CLIMBING FORMWORK, AND METHOD FOR MOVING THE CLIMBING FORMWORK USING SUCH A HYDRAULIC ARRANGEMENT

FIELD OF THE INVENTION

The invention relates to a hydraulic arrangement comprising interconnected hydraulic power units. The invention furthermore relates to a climbing formwork comprising a hydraulic arrangement of this kind. The invention furthermore relates to a method for moving the climbing formwork. Finally, the invention also relates to a hydraulic power unit of a hydraulic arrangement of this kind.

BACKGROUND OF THE INVENTION

It is known to use a climbing formwork in order to construct a building. In this case, a climbing formwork is generally understood to be a climbing frame or climbing system on which a formwork is arranged in order to prepare a wall and/or ceiling. The climbing formwork comprises a plurality of climbing units that are moved up and/or down by means of hydraulic cylinders.

If said climbing units are not moved up or down simultaneously, falling edges result which have to be secured in a laborious manner.

In contrast, if the climbing units are moved synchronously, according to the prior art it is necessary to use a large hydraulic power unit for supplying all the hydraulic cylinders. A hydraulic power unit of this kind is known for example under the designation "Hydraulik Unit SKE", by Doka GmbH. In this case, the hydraulic cylinders are connected to a long hydraulic loop. However, the long hydraulic loop exhibits a pressure loss of approximately 1 bar per meter.

In contrast, if the long loop has a large internal diameter, in order to achieve as little pressure loss as possible, this results in a very large total oscillating volume, since the oscillating volumes of all the hydraulic cylinders and the loop are cumulative. The known hydraulic power unit must then be designed so as to be correspondingly large, which is reflected in a greater space requirement on the climbing formwork.

SUMMARY OF THE INVENTION

In contrast, the object of the present invention is that of providing a hydraulic arrangement which requires significantly less space while having a high capacity. The object of the present invention is furthermore that of providing a climbing formwork comprising a hydraulic arrangement of this kind, a hydraulic power unit of a hydraulic arrangement of this kind, and a method comprising a climbing formwork of this kind.

The object is achieved according to the invention by a hydraulic arrangement, a climbing formwork, a method, and a hydraulic power unit.

The object according to the invention is therefore achieved by a hydraulic arrangement comprising at least two hydraulic cylinders. The hydraulic arrangement comprises at least two hydraulic power units. Each hydraulic power unit is preferably directly connected to a maximum of four hydraulic cylinders. Each hydraulic power unit comprises at least one pump for delivering a fluid flow into the hydraulic cylinder(s). Furthermore, each hydraulic power unit comprises a control unit for controlling the fluid flow. In this case, the control unit can be designed to control one or more valves of the hydraulic power unit and/or to control the pump(s) of the hydraulic power unit. Furthermore, the hydraulic arrangement comprises a data link between at least two control units, in order to allow for synchronization of the hydraulic power units. The data link can be designed to exchange user commands, path signals, pressures and/or error notifications.

The hydraulic arrangement according to the invention thus makes it possible for a plurality of hydraulic cylinders to be raised and/or lowered simultaneously and uniformly in a particularly efficient manner, without it being necessary to provide a large hydraulic power unit having a large oscillating volume.

Preferably more than two hydraulic power units, in particular more than three hydraulic power units, preferably more than four hydraulic power units, particularly preferably more than five hydraulic power units, more preferably more than six hydraulic power units are coupled, in particular in series, by means of the data link.

The concept underlying the invention is therefore that of providing a plurality of hydraulic power units, instead of just one hydraulic power unit or a few hydraulic power units, which hydraulic power units are each associated with just a few hydraulic cylinders, in order to actuate a plurality of hydraulic cylinders. This makes the hydraulic lines between the hydraulic power unit and hydraulic cylinder significantly shorter, as a result of which both pressure losses and oscillating volumes are reduced significantly.

Preferably a plurality of hydraulic power units is each connected to at most three, in particular at most two, particularly preferably just one, hydraulic cylinder. In a more preferred embodiment of the hydraulic arrangement, all the hydraulic power units are each connected to at most three, in particular at most two, particularly preferably just one, hydraulic cylinder.

The maximum length of the individual hydraulic lines of the hydraulic arrangement can in each case be less than 10 m, in particular less than 7 m, preferably less than 5 m, particularly preferably less than 3 m.

The data link can be designed so as to be wireless or wired. The data link can comprise a network and/or a central server.

The data link is preferably designed in the form of a BUS data link. In this case, the BUS data link is preferably designed for expanding the hydraulic arrangement, such that more than two, in particular more than three, preferably more than four, particularly preferably more than five, more preferably any number of hydraulic power units, can be connected by means of the BUS data link. The BUS data link can be designed in the form of a CAN BUS data link, an ethernet BUS data link, a PROFINET BUS data link, or in the form of a BUS data link according to any other industry standard.

The control units of a plurality of, in particular all of, the hydraulic power units can be designed for actuating individual ones of the hydraulic cylinders that are associated with the relevant hydraulic power unit. Alternatively or in addition thereto, the control units of a plurality of hydraulic power units, in particular all the hydraulic power units, can be coupled together such that the hydraulic cylinders of a plurality of, in particular all of, the hydraulic power units are extended or retracted only when a plurality of, in particular all of, the control units of the hydraulic arrangement order or allow the extension or retraction of the hydraulic cylinders.

The control units can be designed for master/slave operation, in which a first control unit, as the master, controls at least one further control unit of the hydraulic arrangement, in particular all further control units of the hydraulic arrangement, as the slave. In this case, the control unit of the hydraulic arrangement that, as the master, controls further control units, can be selected from the total number of all control units of the hydraulic arrangement. Each control unit can therefore electively be operated as the master or slave unit. In addition thereto, the control units can also be designed for individual operation, in which the control units of the hydraulic arrangement in each case actuate only the hydraulic cylinder associated with the hydraulic power unit thereof. In this case, the control units can comprise a switch, at which switching between the actuation of individual hydraulic cylinders associated with the relevant hydraulic power unit (standalone operation), and synchronous actuation of a plurality of, in particular all of, the hydraulic cylinders, takes place. It is thus possible, for setup operation and/or troubleshooting, for just individual hydraulic cylinders to be extended or retracted.

The hydraulic arrangement can comprise a first remote control. The first remote control can be connected to the first control unit in a wired or wireless manner. In a preferred embodiment, the control unit that is connected to the remote control can be defined as the master control unit, which controls further control units as slaves.

In addition thereto, the hydraulic arrangement can comprise a second remote control. The second remote control can be connected to the second control unit in a wired or wireless manner. The first remote control and the second remote control can be designed identically.

Preferably, the control units of the hydraulic arrangement are connected such that the movement of the hydraulic cylinders is stopped if two control units are actuated differently, in particular by means of one remote control each. It is thus possible for two people, who are not in visual contact with one another, to reliably monitor the raising and/or lowering of the hydraulic arrangement.

The hydraulic arrangement can comprise a superordinate control unit which is connected to at least one first control unit of the hydraulic arrangement, in order to control the control units of a plurality of hydraulic power units, in particular all the hydraulic power units.

In a particularly preferred embodiment of the invention, the line voltage or the supply voltage is "looped through" the hydraulic power units. For this purpose, a first hydraulic power unit is connected to the line voltage. An electrical connection indirectly supplies at least one second hydraulic power unit with said line voltage. As a result, only a few hydraulic power units, in particular only the first hydraulic power unit, has to be directly connected to the line voltage.

At least one hydraulic power unit, in particular a plurality of hydraulic power units, preferably all of the hydraulic power units, can comprise an automatic phase inverter, in order that the correct rotating field can always be applied to the motor.

At least one hydraulic power unit, in particular a plurality of hydraulic power units, preferably all the hydraulic power units, can be designed so as to be connected to a voltage network 3L+PE of 400 V/50 Hz and/or 480 V/60 Hz. As a result, the hydraulic arrangement can be used anywhere.

At least one hydraulic power unit can comprise an electric motor that drives at least two pumps, in particular exactly two pumps, on a common shaft. In this case, each pump is preferably associated with one hydraulic cylinder, the pumps being connected to the hydraulic cylinders by means of hydraulic lines in each case. It is preferably also possible for directional valves to be integrated in the hydraulic lines. This makes it possible for the hydraulic cylinders to be actuated selectively. It is thus also possible, for example, for just one hydraulic cylinder to be operated on the hydraulic power unit, which makes possible operation with an uneven number of hydraulic cylinders.

At least one hydraulic power unit can comprise an electric motor in the form of an oil-immersed motor. The hydraulic power unit can thereby be operated in a particularly quiet and efficient manner.

A plurality of hydraulic power units, in particular all the hydraulic power units, can be designed identically. Alternatively or in addition thereto, a plurality of hydraulic cylinders, in particular all the hydraulic cylinders, can be designed identically.

At least a first hydraulic power unit can be directly attached to a hydraulic cylinder. As a result, a particularly efficient and space-saving hydraulic arrangement is achieved.

In order to achieve adequate synchronous running of the hydraulic cylinders, in particular in the event of different load levels, at least one first hydraulic power unit, in particular a plurality of hydraulic power units in each case, preferably all of the hydraulic power units in each case, can comprise a volume flowmeter for hydraulic fluid in order to precisely synchronize the extension or retraction of the hydraulic cylinders.

Alternatively or in addition thereto, the hydraulic arrangement can comprise a path measurement system in the region of one or more hydraulic cylinders, in order to precisely synchronize the retraction or insertion of the hydraulic cylinder. It may be possible for data from the path measurement system to be communicated between a plurality of hydraulic power units, via the data link.

The hydraulic arrangement may comprise a pressure gage in order to monitor the pressures at the individual hydraulic cylinders. It may be possible for data measured by the pressure gage to be communicated between a plurality of hydraulic power units, via the data link. In the event of an overload, the system can be designed to shut down. In addition thereto, the hydraulic arrangement can be designed to output an error message in order to provide information about the type and origin of the fault.

In a more preferred embodiment of the invention, the hydraulic arrangement is designed to alternately actuate hydraulic cylinder pairs, in particular in the case of extension, in order to limit the current requirement of the hydraulic arrangement. The small falling edges resulting in this case are non-hazardous with respect to safety. Since generally no work is performed when retracting the hydraulic cylinder, all the hydraulic cylinders can be designed to retract together.

The hydraulic arrangement can comprise a diagnostics screen. The diagnostics screen is indirectly or directly connected to the data link. The diagnostics screen can be designed for displaying operating pressures, movements of the hydraulic cylinders, error messages and/or user commands. The diagnostics screen can be integrated in a hydraulic power unit.

The hydraulic arrangement can comprise a data logger. The data logger is indirectly or directly connected to the data link. The data logger can be designed for recording operating data, such as operating pressures, movements of the hydraulic cylinders, error messages and/or user commands. The data logger can thus provide information on the procedures on the construction site.

The hydraulic arrangement may comprise a remote maintenance module. The remote maintenance module is indirectly or directly connected to the data link. The remote maintenance module can be designed for reading out the operating data. Alternatively or in addition thereto, the remote maintenance module can be designed for supplying the control units of a plurality of hydraulic arrangements with a new software version and/or different data.

The hydraulic arrangement may comprise a release module. The release module is indirectly or directly connected to the data link. The release module can be designed to allow for actuation of the hydraulic cylinder only after a release signal has been sent, in particular by the site management.

The object according to the invention is furthermore achieved by a climbing formwork comprising at least one climbing unit, in particular a plurality of climbing units, and a hydraulic arrangement described above. Each climbing unit comprises at least one hydraulic power unit, in particular exactly one hydraulic power unit, and at most four hydraulic cylinders that are connected to the hydraulic power unit.

The object according to the invention is furthermore achieved by a method for moving a climbing formwork described above. In the method according to the invention, two climbing units are moved synchronously, each climbing unit comprising a hydraulic power unit, the controllers of which are interconnected by means of the data link.

In the method, the climbing units can be stopped if at least two control units are activated or actuated differently.

Preferably, the control unit of a first hydraulic power unit or a superordinate control unit controls the control units of more than one further hydraulic power unit, in particular more than two hydraulic power units, preferably more than three hydraulic power units, particularly preferably more than four hydraulic power units.

The method can thus be carried out such that the hydraulic cylinders of a plurality of, in particular all of, the hydraulic power units are extended or retracted only when a plurality of, in particular all of, the control units of the hydraulic arrangement order or allow the extension or retraction of the hydraulic cylinders.

The method can thus be carried out such that the movement of the hydraulic cylinders is stopped if two control units are actuated differently, in particular by means of one remote control each.

A plurality of control units of the hydraulic arrangement, in particular all the control units of the hydraulic arrangement, can be controlled by means of a superordinate control unit.

In a more preferred variant of the method, hydraulic cylinder pairs are actuated, in particular extended, alternately, in order to limit the power requirement of the hydraulic arrangement.

Preferably all the hydraulic cylinders are retracted together.

The extension and/or retraction of the hydraulic cylinders preferably takes place in master/slave operation of the control units.

The object according to the invention is furthermore achieved by a hydraulic power unit of a hydraulic arrangement described above. The hydraulic power unit is designed for connecting at least one hydraulic cylinder. Preferably at least one hydraulic cylinder is connected to the hydraulic power unit.

Further features and advantages of the invention can be found in the following detailed description of a plurality of embodiments of the invention, with reference to the figures of the drawings which show details that are essential to the invention, and in the claims.

BRIEF DESCRIPTION OF THE DRAWINGS

The features shown schematically in the drawings are not necessarily to be considered as being to scale, and are set out such that the particularities according to the invention can be made clearly visible. For reasons of clarity, often just one component or a few of the same components are provided with reference signs in the drawings. The various features can be achieved individually, in each case, or together in any desired combinations, in variants of the invention.

In the figures.

DETAILED DESCRIPTION

Figure 1:
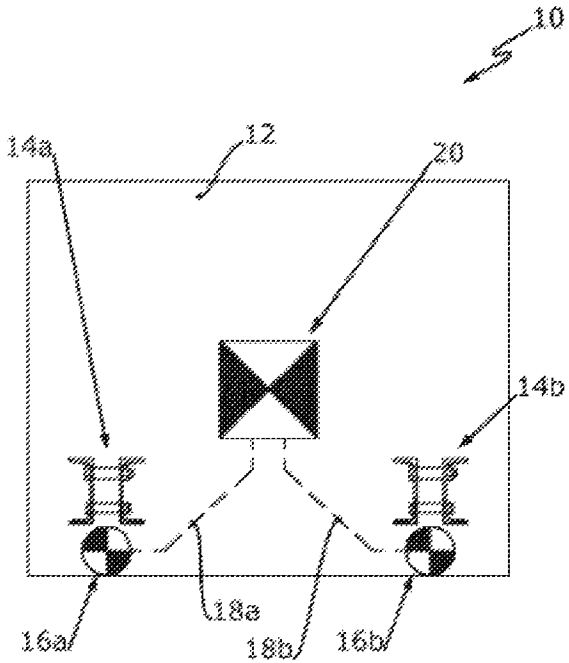
FIG. 1 shows a climbing unit comprising two hydraulic cylinders that are supplied by means of one hydraulic power unit.

FIG. 1 shows a climbing unit 10 comprising a platform 12. The platform 12 can be moved up and down, along climbing rails 14*a*, 14*b*. In this case, the movement is achieved by means of hydraulic cylinders 16*a*, 16*b*. The hydraulic cylinders 16*a*, 16*b* are connected to a hydraulic power unit 20 by means of hydraulic lines 18*a*, 18*b*. Since the hydraulic power unit 20 has to supply only the two hydraulic cylinders 16*a*, 16*b* with fluid, the hydraulic lines 18*a*, 18*b* can be designed so as to be short. The oscillating volume of the hydraulic power unit 20 is also correspondingly small, and therefore the hydraulic power unit 20 can be of a correspondingly small size.

Figure 2:
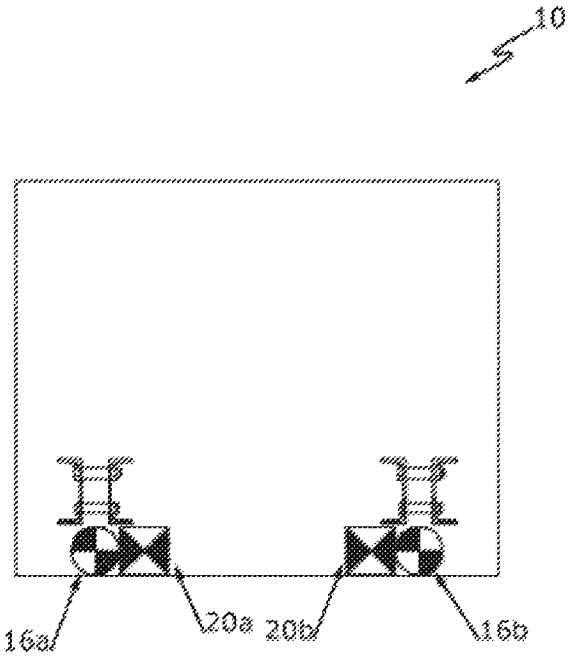
FIG. 2 shows a climbing unit comprising two hydraulic cylinders that are each supplied by means of one hydraulic power unit, respectively.

FIG. 2 shows a climbing unit 10 comprising two hydraulic cylinders 16*a*, 16*b*, in which each hydraulic cylinder 16*a*, 16*b* is assigned its own hydraulic power unit 20*a*, 20*b*. As a result, hydraulic lines between the hydraulic power units 20*a*, 20*b* and the hydraulic cylinders 16*a*, 16*b* can be designed so as to be very short, or can be omitted entirely.

Figure 3:
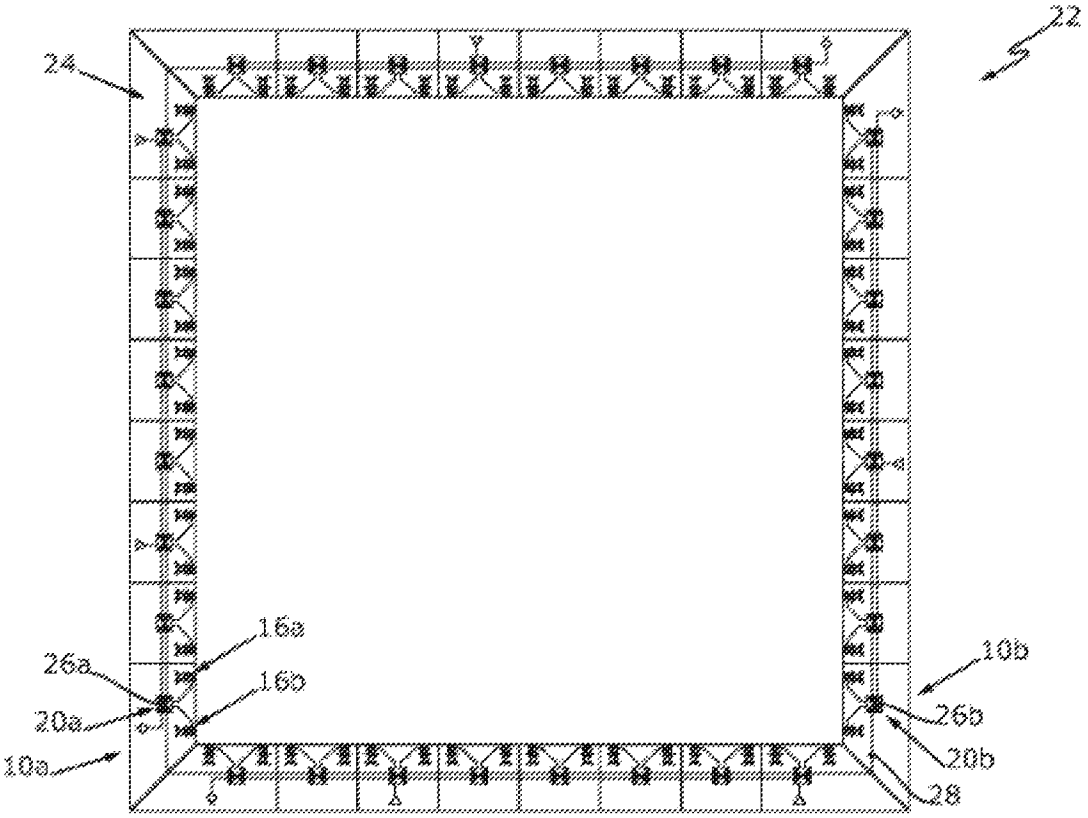
FIG. 3 shows a climbing formwork comprising a plurality of climbing units.

FIG. 3 shows a climbing formwork 22 comprising a plurality of climbing units 10*a*, 10*b*. The climbing units 10*a*, 10*b* of the climbing formwork 22 are provided with a hydraulic arrangement 24 that is designed to move all the climbing units 10*a*, 10*b* of the climbing formwork 22 synchronously. For this purpose, the climbing units 10*a*, 10*b* each comprise a hydraulic power unit 20*a*, 20*b* that is hydraulically connected to the hydraulic cylinder 16*a*, 16*b*.

The hydraulic power units 20*a*, 20*b* each comprise a control unit 26*a*, 26*b*. The control units 26*a*, 26*b* are connected by means of a data link 28. The data link 28 is designed in the form of a BUS data link that allows for the synchronous actuation of all the control units 26*a*, 26*b*. In this case, a user of one of the control units 26*a*, 26*b*, for example the control unit 26*a*, actuates all the control units 26*a*, 26*b*. In the embodiment according to FIG. 3, the data link 28 connects all the control units 26*a*, 26*b* of the hydraulic arrangement 24. In the present case, the data link 28 is designed in the manner of a loop.

Figure 4:
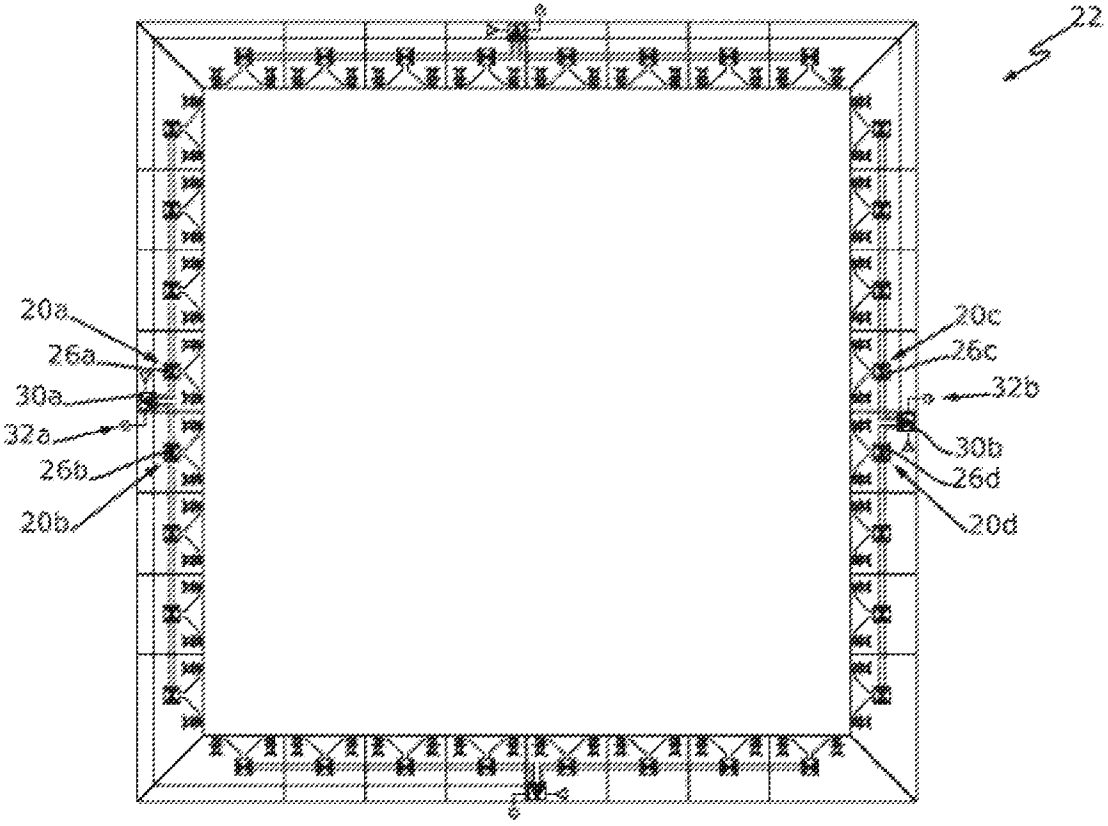
FIG. 4 shows a climbing formwork comprising a plurality of climbing units and a superordinate control unit.

FIG. 4 shows a further climbing formwork 22. Control units 26*a*, 26*b*, 26*c*, 26*d* of the climbing formwork 22 are controlled by superordinate control units 30*a*, 30*b*. A line voltage connection 32*a*, 32*b* for hydraulic power units 20*a*-20*d* can be provided on the superordinate control units 30*a*, 30*b*.

Figure 5:
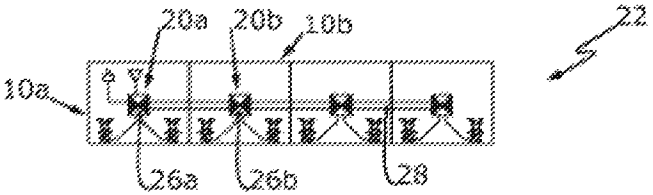
FIG. 5 shows a climbing formwork comprising four coupled climbing units.

FIG. 5 shows a climbing formwork 22 comprising a plurality of climbing units 10*a*, 10*b*. All the climbing units 10*a*, 10*b* of the climbing formwork 22 are connected by means of a data line or data link 28. The data link 28 synchronizes the control units 26*a*, 26*b* of the hydraulic power units 20*a*, 20*b*. As a result, the hydraulic power units 20*a*, 20*b* can be designed so as to be small and effective.

Figure 6:
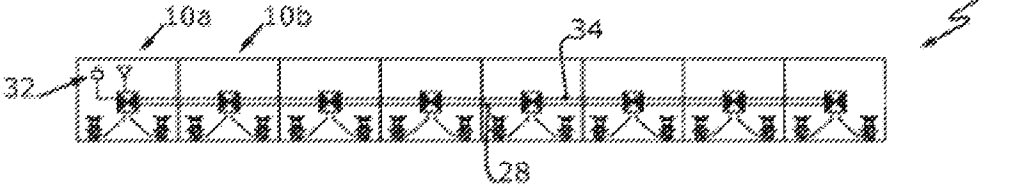
FIG. 6 shows a climbing formwork comprising eight coupled climbing units.

FIG. 6 shows a climbing formwork 22 comprising a plurality of climbing units 10*a*, 10*b* that are connected in series by means of a data link 28. Furthermore, the climbing formwork 22 comprises just one line voltage connection 32 which supplies all the climbing units 10*a*, 10*b* with line voltage. In this case, an electrical connection 34 serially connects a plurality of climbing units 10*a*, 10*b*, in particular all the climbing units 10*a*, 10*b*, to the line voltage connection 32.

Figure 7:
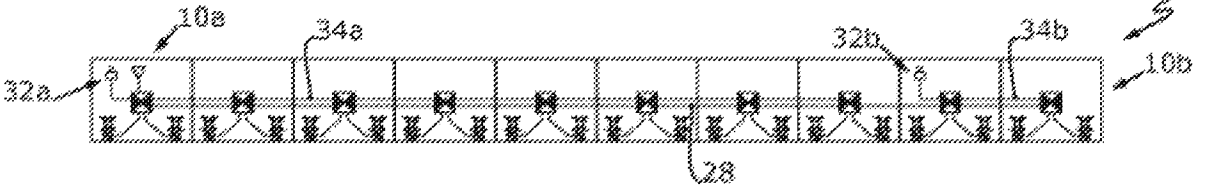
FIG. 7 shows a climbing formwork comprising ten coupled climbing units.

FIG. 7 shows a climbing formwork 22, the climbing units 10*a*, 10*b* of which are supplied by means of line voltage connections 32*a*, 32*b*. Electrical connections 34*a*, 34*b* are provided for this purpose. In contrast, all the climbing units 10*a*, 10*b* are connected by means of a single data link 28.

Figure 8:
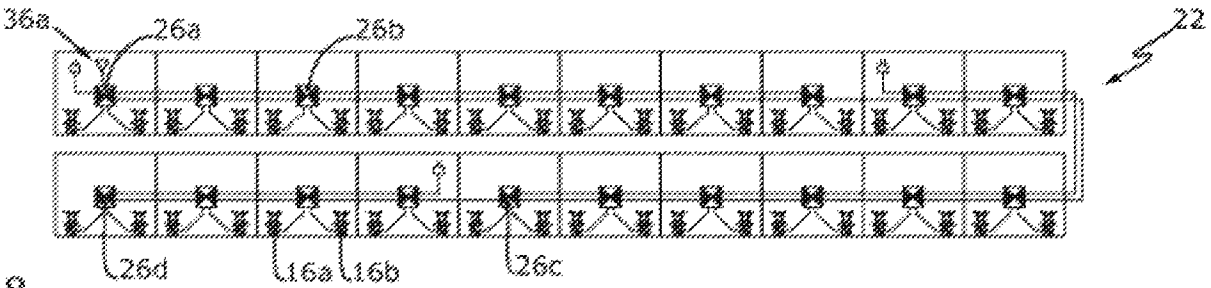
FIG. 8 shows a climbing formwork comprising twenty coupled climbing units.

FIG. 8 shows a climbing formwork 22 comprising a control unit 26*a* that is connected to a remote control 36*a*. The remote control 36*a* is designed for controlling the control unit 26*a*. If the further control units 26*b*-26*d* of the climbing formwork 22 are switched to operate synchronously with the control unit 26*a*, it is thus possible for all the hydraulic cylinders 16*a*, 16*b* of the climbing formwork 22 to be controlled synchronously by the remote control 36*a*.

Figure 9:
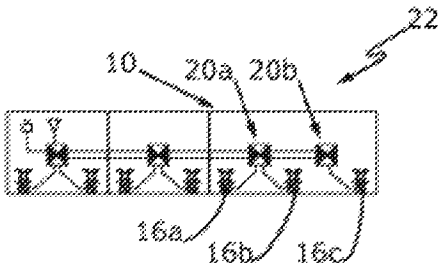
FIG. 9 shows a climbing formwork comprising a plurality of climbing units, the climbing units comprising a different number of hydraulic cylinders.

FIG. 9 shows a climbing formwork 22 comprising a climbing unit 10 that comprises two hydraulic power units 20*a*, 20*b*. In this case, the hydraulic power unit 20*a* is connected to two hydraulic cylinders 16*a*, 16*b*, and the hydraulic power unit 20*b* is connected to one hydraulic cylinder 16*c*. The hydraulic power units 20*a*, 20*b* are designed identically and can electively be connected to one or two hydraulic cylinders 16*a*-16*c*.

Figure 10:
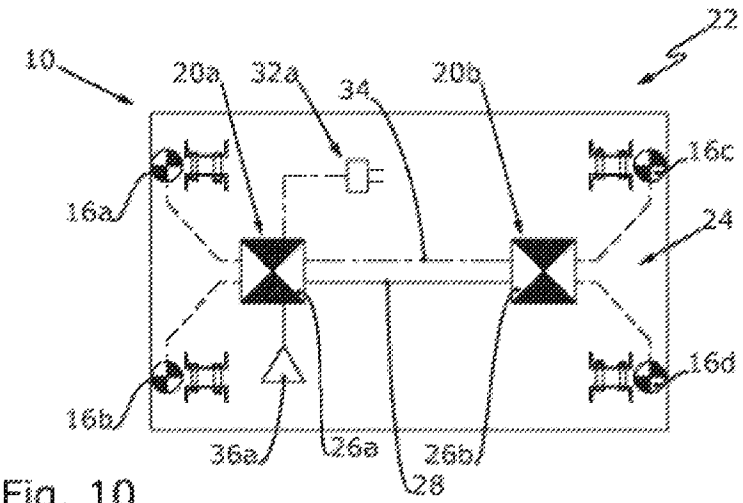
FIG. 10 shows a climbing formwork comprising a single climbing unit having four hydraulic cylinders.

FIG. 10 shows a climbing formwork 22 comprising a single climbing unit 10. The climbing unit 10 comprises two hydraulic power units 20*a*, 20*b*, the control units 26*a*, 26*b* of which are designed for synchronous control of hydraulic cylinders 16*a*, 16*b*, 16*c*, 16*d*. The adjustment of the control units 26*a*, 26*b* is made possible by means of the data link 28. The control unit 26*a* is operated, and thus the control unit 26*b* is also influenced, by means of a remote control 36*a*. A line voltage connection 32*a* supplies the hydraulic power unit 20*a* directly, and, by means of an electrical connection 34 supplies the hydraulic power unit 20*b* indirectly, with supply voltage. The hydraulic arrangement 24 of the climbing unit 10 can in particular be used for climbing in a shaft.

Figure 11:
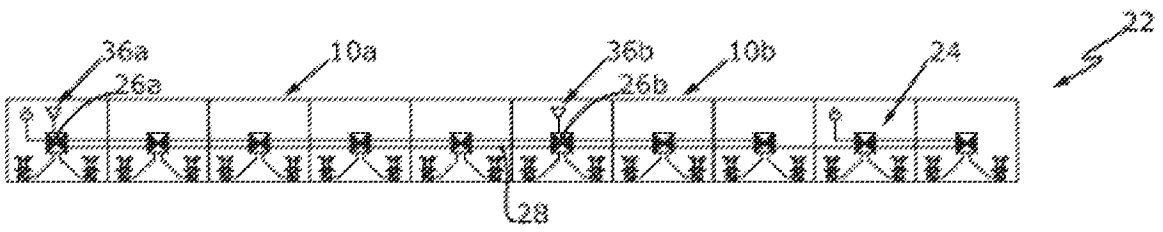
FIG. 11 shows a climbing formwork comprising two remote controls.

FIG. 11 shows a climbing formwork 22, the climbing units 10*a*, 10*b* of which communicate by means of a data link 28. The data link 28 is connected directly or, as shown in FIG. 11, indirectly, by means of a control unit 26*a*, to a remote control 36*a*. Furthermore, the data link 28 is connected directly or, as shown in FIG. 11, indirectly, by means of a control unit 26*b*, to a remote control 36*b*. The hydraulic arrangement 24 can electively be controlled by the remote control 36*a* or the remote control 36*b*. The other remote control 36*a*, 36*b* in each case can be used for monitoring or observation, e.g. if an operator cannot see the entire climbing formwork 22.

Figure 12:
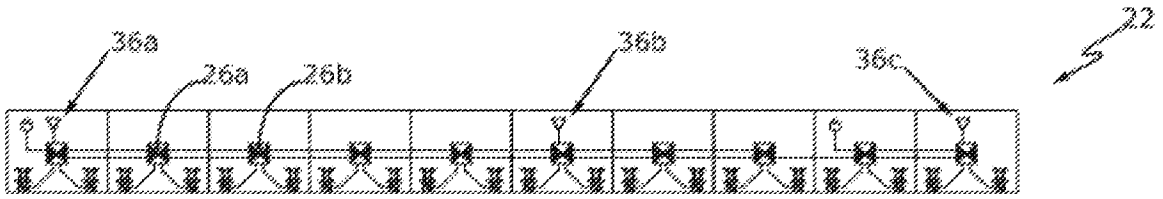
FIG. 12 shows a climbing formwork comprising three remote controls.

FIG. 12 shows a climbing formwork 22, in which the control units 26*a*, 26*b* of the climbing formwork 22 can be electively controlled by means of a remote control 36*a*, a remote control 36*b* or a remote control 36*c*. The remaining two remote controls 36*a*-36*c* can be used for monitoring the climbing process.

Figure 13:
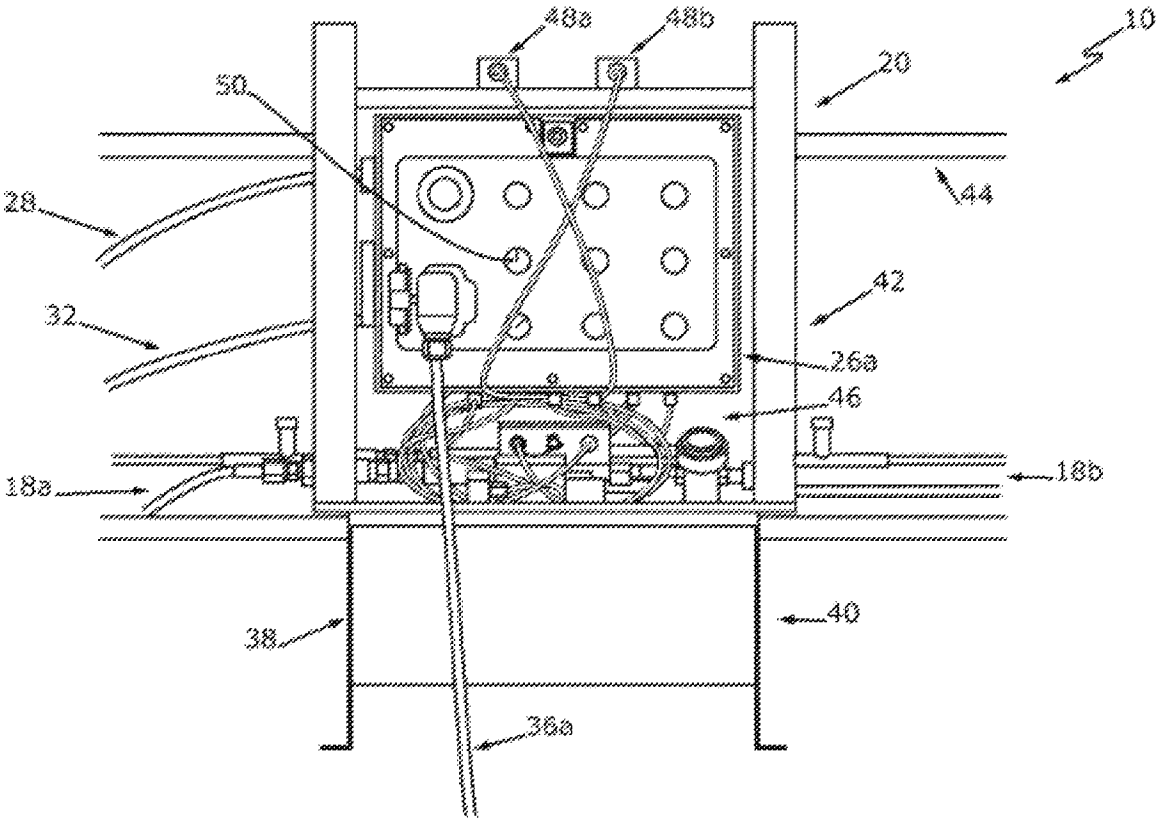
FIG. 13 is a partial view of a climbing unit comprising a hydraulic power unit.

FIG. 13 shows a portion of a climbing unit 10 comprising a hydraulic power unit 20. The hydraulic power unit 20 comprises a hydraulic unit 38 having a hydraulics housing 40. The hydraulic power unit 20 furthermore comprises a control unit 26*a* which is arranged in a control case 42. In the present case, the control case 42 is formed in a frame-like manner. The hydraulics housing 40 is arranged on the control case 42 so as to be reversibly detachable, with the result that the hydraulic power unit 20 is formed in a modular manner. This facilitates the servicing of the hydraulic power unit 20. The hydraulic power unit 20 is designed for being placed on the ground and/or for being fastened to a railing 44 of the climbing unit 10.

The hydraulic unit 38 comprises a motor (not shown) in the form of an oil-immersed motor. The motor actuates two pumps (not shown) in the hydraulic unit 38. The pumps supply hydraulic lines 18*a*, 18*b* with fluid, the hydraulic lines 18*a*, 18*b* supplying hydraulic cylinders (not shown).

The control unit 26*a* controls the motor. Alternatively or in addition thereto, the control unit 26*a* can control valves and/or throttles 46 which are connected to the hydraulic lines 18*a*, 18*b*. Pressure gages 48*a*, 48*b* check the pressure in the hydraulic lines 18*a*, 18*b*, so that the control unit 26*a* can carry out pressure regulation.

A line voltage connection 32 and a data link 28 are connected to the control unit 26*a*. It is furthermore possible for a remote control 36*a* to be connected to the control unit 26*a*, the connection cable of which remote control is visible in FIG. 13.

The control unit 26*a* can comprise a switch 50, at which actuation of a first hydraulic cylinder and/or of a second hydraulic cylinder or of the hydraulic lines 18*a*, 18*b* can be selected. Furthermore, it is possible to select, at the switch 50, control of the control unit 26*a* by means of a further control unit (not shown) that is connected to the control unit 26*a* via the data link 28.

Figure 14:
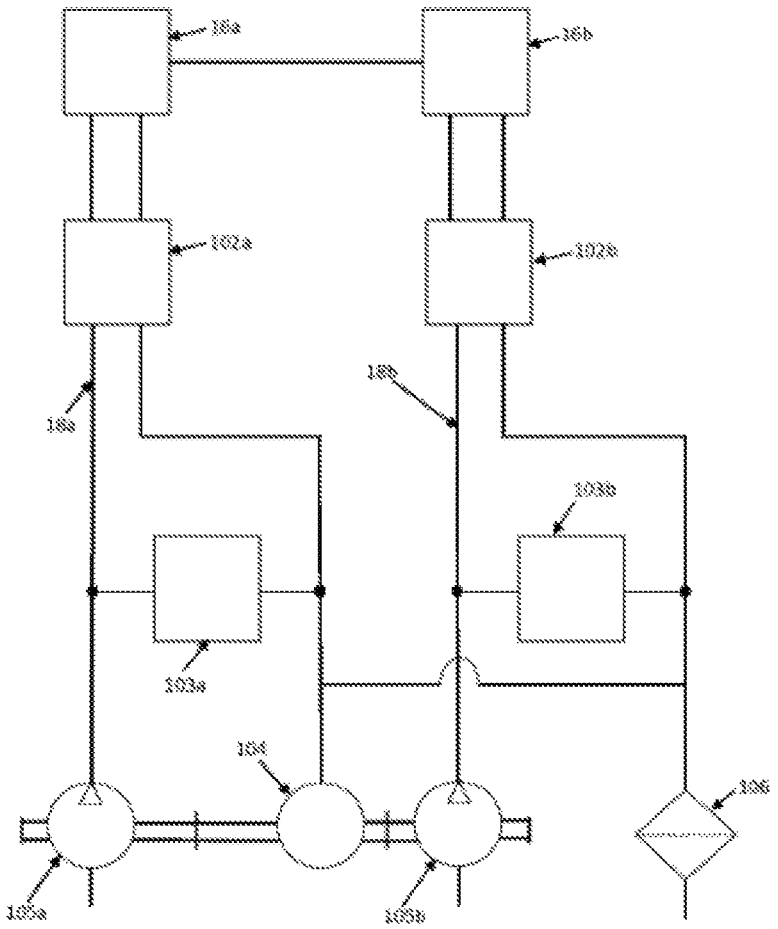
FIG. 14 shows a hydraulic power unit assembly comprising two pumps that are driven by a common motor.

FIG. 14 shows a hydraulic power unit assembly that comprises a motor 104. The motor 104 drives two pumps 105*a*, 105*b* by means of a common shaft of the motor 104. In this case, the pump 105*a* is associated with the hydraulic cylinder 16*a*, and the pump 105*b* is associated with the hydraulic cylinder 16*b*, the hydraulic cylinders 16*a*, 16*b* being connected to the two pumps 105*a*, 105*b* by means of hydraulic lines 18*a*, 18*b*. Furthermore, two directional valves 102*a*, 102*b*, two pressure limiters 103*a* 103*b* and a filter 106 are integrated into the hydraulic lines 18*a*, 18*b*. In particular the integration of the directional valves 102*a*, 102*b* makes it possible for the hydraulic cylinders 16*a*, 16*b* to be able to be actuated selectively. It is thus possible, for example, in one embodiment, for just one of the two hydraulic cylinders 16*a*, 16*b* to be operated. Complete shutdown of the cylinders is likewise possible.

Considering all the figures of the drawings in overview, the invention relates, in summary, to a hydraulic arrangement 10, 10*a*, 10*b*. The hydraulic arrangement 10, 10*a*, 10*b* comprises a plurality of hydraulic power units 20, 20*a*-20*d*, the control units 26*a*-26*d* of which are connected, in particular in series, by means of a data link 28. The control units 26*a*-26*d* are preferably designed to electively control only the directly associated hydraulic cylinders 16*a*-16*d* thereof or to also control, indirectly via the data link 28 and the control unit 26*a*-26*d* of a further hydraulic power unit 20, 20*a*-20*d*, the hydraulic cylinders 16*a*-16*d* associated with said hydraulic power unit 20, 20*a*-20*d*. The invention further relates to a climbing formwork 22 comprising at least one climbing unit 10, 10*a*, 10*b*, in particular a plurality of climbing units 10, 10*a*, 10*b*. The hydraulic power units 20, 20*a*-20*d* can be interconnected, by means of the data link 28, such that synchronous raising and/or lowering of all the climbing units 10, 10*a*, 10*b* can be achieved or is achieved. The hydraulic power units 20, 20*a*-20*d* are preferably connected in a master/slave arrangement or are preferably controlled in master/slave operation. More preferably, the hydraulic power units 20, 20*a*-20*d* are designed for switching from master/slave operation to standalone operation.

The invention claimed is:

1. A hydraulic arrangement for a climbing formwork, the hydraulic arrangement comprising:

a) at least two hydraulic cylinders for raising and/or lowering a portion of the climbing formwork;

b) at least two hydraulic power units, wherein each hydraulic power unit comprises at least one pump for delivering a fluid into the hydraulic cylinders and a control unit for controlling the fluid flow, wherein the control unit of the hydraulic arrangement that, as a master, controls further control units, is selectable from a total number of all control units of the hydraulic arrangement, wherein each hydraulic power unit is connected to at most four hydraulic cylinders of a climbing unit of the climbing formwork;

c) a data link between at least two control units of the hydraulic power unit, in order to allow for synchronous raising and/or lowering of the hydraulic cylinders.

2. The hydraulic arrangement according to claim 1, in which each hydraulic power unit is connected to at most two hydraulic cylinders of a climbing unit.

3. The hydraulic arrangement according to claim 1, in which the data link is designed in the form of a BUS data link.

4. The hydraulic arrangement according to claim 1, in which the control units of the hydraulic power units are coupled together, such that i) the hydraulic cylinders are extended only if all the control units order or allow the extension of the hydraulic cylinders associated therewith, and/or ii) the hydraulic cylinders are retracted only if all the control units order or allow the retraction of the hydraulic cylinders associated therewith.

5. The hydraulic arrangement according to claim 1, in which the hydraulic arrangement comprises a first remote control that is connected to a first control unit of a first hydraulic power unit.

6. The hydraulic arrangement according to claim 5, in which the hydraulic arrangement comprises a second remote control that is connected to a second control unit of a second hydraulic power unit.

7. The hydraulic arrangement according to claim 1, in which the hydraulic arrangement comprises a superordinate control unit that is connected to the control unit of a first hydraulic power unit in order to control the control units of a plurality of hydraulic power units.

8. The hydraulic arrangement according to claim 1, in which a first hydraulic power unit is connected to a line voltage, wherein the hydraulic arrangement comprises an electrical connection between the first hydraulic power unit and a second hydraulic power unit, in order to also supply the second hydraulic power unit with line voltage.

9. The hydraulic arrangement according to claim 1, in which at least one first hydraulic power unit comprises a motor, at least two pumps and a shaft, where the at least two pumps can be driven by means of the motor, via the same shaft.

10. The hydraulic arrangement according to claim 1, in which the motor of a first hydraulic power unit is designed in the form of an oil-immersion motor.

11. A climbing formwork comprising at least one climbing unit, and a hydraulic arrangement according to claim 1, wherein each climbing unit comprises a hydraulic power unit and at most four hydraulic cylinders that are actuated by a hydraulic power unit.

12. A method for moving a climbing formwork according to claim 11, wherein the method comprises:

A) actuating a second control unit of a second hydraulic power unit using a first control unit of a first hydraulic power unit, by means of the data link;

B) moving the hydraulic cylinder associated with a first climbing unit synchronously with the hydraulic cylinder associated with a second climbing unit.

13. The method according to claim 12, in which the movement of the climbing units is stopped if the two control units are actuated differently.

14. The method according to claim 12, in which the second control unit of more than one hydraulic power unit is controlled by the first control unit of the first hydraulic power unit or by a superordinate control unit.

15. The method according to claim 14, in which the second control unit of more than one hydraulic power unit comprises at least one of: the second control unit of more than two hydraulic power units; the second control unit of more than three hydraulic power units, or the second control unit of more than four hydraulic power units.

16. The hydraulic arrangement according to claim 1, wherein the control units are configured for individual operation, in which the control units of the hydraulic arrangement in each case actuate only the hydraulic cylinder associated with the hydraulic power unit thereof, wherein the control units comprise a switch, at which switching between the actuation of individual hydraulic cylinders associated with the relevant hydraulic power unit and synchronous actuation of a plurality of the hydraulic cylinders can take place.

17. A hydraulic arrangement for a climbing formwork, the hydraulic arrangement comprising:

at least four hydraulic power units, wherein each hydraulic power unit comprises at least one pump for delivering a fluid into the hydraulic cylinders and a control unit for controlling the fluid flow such that a first control unit associated with a first hydraulic power unit is configured as a master control unit and is configured to control a second control unit associated with at least a second hydraulic power unit, a third control unit associated with at least a third hydraulic power unit, and a fourth control unit associated with at least a fourth hydraulic power unit, wherein each hydraulic power unit is connected to at most four hydraulic cylinders of a climbing unit of the climbing formwork;

a data link between the first, second, third, and fourth control units of the at least four hydraulic power units, in order to allow for synchronous raising and/or lowering of the hydraulic cylinders.

* * * * *